US005876137A

United States Patent [19]

Byrd

[11] Patent Number: 5,876,137

[45] Date of Patent: Mar. 2, 1999

[54] OUTER SHELL FOR A COSMETIC CONTAINER FOR PREVENTING ACCIDENTAL REMOVAL OF THE SHELL'S COVER

[75] Inventor: Richard L. Byrd, Cheshire, Conn.

[73] Assignee: Rexam Cosmetic Packaging, Inc., Torrington, Conn.

[21] Appl. No.: 858,596

[22] Filed: May 19, 1997

[51] Int. Cl.[6] ..... A45D 40/00

[52] U.S. Cl. ..... 401/78; 401/98; 215/222; 220/293

[58] Field of Search ..... 401/78, 98; 215/222; 220/293

[56] References Cited

U.S. PATENT DOCUMENTS

| | | | |
|---|---|---|---|
| 2,071,265 | 2/1937 | Schmidt . | |
| 2,798,598 | 7/1957 | Abbotts . | |
| 3,836,034 | 9/1974 | Lecinski, Jr. | 215/9 |
| 4,051,974 | 10/1977 | Gentile . | |
| 4,289,248 | 9/1981 | Lynn . | |
| 4,353,479 | 10/1982 | Nakamura et al. | 220/301 |
| 4,361,243 | 11/1982 | Virtanen . | |
| 4,387,821 | 6/1983 | Geiger . | |
| 4,832,220 | 5/1989 | Quennessen . | |
| 5,139,164 | 8/1992 | Stewart . | |
| 5,145,080 | 9/1992 | Imbery, Jr. . | |
| 5,160,057 | 11/1992 | Fitjer . | |
| 5,186,561 | 2/1993 | Ackermann et al. | 401/78 |
| 5,445,466 | 8/1995 | Mukunoki . | |
| 5,449,078 | 9/1995 | Akers . | |
| 5,454,476 | 10/1995 | King et al. . | |
| 5,533,823 | 7/1996 | Pierpont et al. . | |
| 5,552,117 | 9/1996 | Burns . | |
| 5,636,930 | 6/1997 | Holloway . | |

FOREIGN PATENT DOCUMENTS

| | | |
|---|---|---|
| 861 633 | 2/1941 | France . |
| 2 572 369 | 5/1986 | France . |

*Primary Examiner*—Henry J. Recla
*Assistant Examiner*—Lynette Goodwin
*Attorney, Agent, or Firm*—Bell Seltzer; Intellectual Property Law Group of Alston & Bird LLP

[57] ABSTRACT

A protective outer shell for a cosmetic container, such as a lipstick container, having a tubular shell cover and a tubular shell base wherein the shell cover is positively retained on the shell base. The shell cover includes at least one radially inwardly extending rib extending along an inner surface of the cover. The rib cooperates with a locking member extending radially outward from the shell base so that the shell cover is moveable between a locked and unlocked position. In the locked position, rotational and axial movement of the shell cover relative to the shell base is limited to prevent accidental removal of the cover from the base.

22 Claims, 4 Drawing Sheets

OUTER SHELL FOR A COSMETIC CONTAINER FOR PREVENTING ACCIDENTAL REMOVAL OF THE SHELL'S COVER

FIELD OF THE INVENTION

The present invention is directed to a cosmetic container having a protective outer shell including a shell base and shell cover which is positively retained upon the shell base to prevent accidental removal therefrom.

BACKGROUND OF THE INVENTION

Cosmetic containers, by nature, must be readily portable so as to be carried by the consumer. For instance, cosmetic containers are frequently carried in a purse or packed within a suitcase for travel. The containers must, therefore, be durable and remain closed so as to withstand significant shifting and possible impact. This is particularly true for lipstick containers which are relatively small, frequently haphazardly placed, and often subjected to significant jarring. If the cover of the cosmetic container is easily dislodged from the shell base, it may be unintentionally released, causing the lipstick or other cosmetic contained therein to become damaged; not to mention damage to the purse or other case holding the cosmetic container. It is, therefore, important for the cosmetic container cover to be securely retained upon the shell base to prevent axial movement of the cover relative to the shell base to avoid accidental removal of the cover during transport of the container.

Another problem associated with cosmetic containers, including lipstick containers, is that even if the cover of the container remains intact with the shell base, the cosmetic contained therein may be unintentionally extended from within the shell base. This results in accidental contact of the cosmetic with the inner surface of the cover, resulting in damage to the cosmetic contained therein. Thus, it is important to prevent relative rotational movement between the shell base and the cover to protect the integrity of the cosmetic within the container.

Prior art attempts to provide containers having locking arrangements for mating the cover and shell base have not adequately addressed the aforementioned problems. For instance, several attempts provide positive retention of the cover on the shell base, but do so in a manner which is structurally complicated and therefore relatively expensive to manufacture. For example, U.S. Pat. No. 5,160,057 to Fitjer is directed to a cosmetic container, such as for mascara, wherein a locking arrangement is provided to prevent further rotational movement of the threaded closure cap relative to the base. The cosmetic container includes a base element having a square cross-section and a threaded neck and a threaded closure cap. A locking arrangement is provided which includes two stop shoulders and two stop returns mounted on the base element and two stop and catch protrusions extending inwardly from the interior surface of the closure cap. Accordingly, in use, the screw closure cap is threaded upon the cosmetic container base element wherein the stop catch protrusion rides over the return stop until abutting the stop shoulder to prevent further rotational movement. This arrangement, however, requires threaded members which must be accurately manufactured.

U.S. Pat. No. 2,071,265 to Schmidt is directed to a metal container having a body portion and a cover which does not require threaded members. The metal container according to this patent, however, is complex in that two different locking arrangements are required to prevent both rotational and axial movement of the container cover relative to the body portion. Axial movement is limited by the locking arrangement including a locking lug extending radially outwardly from the body portion and an inwardly extending locking lug of the container cover. Rotational movement is limited by an inwardly extending protrusion of the cover which mates with recesses of the locking lugs. Thus, a complicated structure is disclosed wherein axial and rotational movement of the cover relative to the base requires two distinct locking arrangements.

SUMMARY OF THE PRESENT INVENTION

It is therefore an object of the present invention to provide a cosmetic container which prevents accidental removal of the container cover.

It is also an object of the present invention to provide a cosmetic container which may be economically manufactured.

The present invention is directed to a cosmetic container, such as a lipstick container, having a protective outer shell. The outer shell includes a tubular shell base and a tubular shell cover. The tubular shell base includes a lower cylindrical wall portion, and at its upper end, a reduced diameter wall portion. The tubular shell cover is selectively positioned upon the tubular shell base and is movable between a locked and unlocked position so that in the locked position, both relative axial and rotational movement between the tubular shell cover and the tubular shell base are prevented. The tubular shell cover includes at least one radially inwardly extending rib extending along at least a portion of the inner surface. The reduced diameter wall portion of the tubular shell base includes a radially outwardly extending locking member including an axial locking ledge to mate with the rib of the shell cover to substantially prevent relative axial movement therebetween in the locked position. The reduced diameter wall portion of the tubular shell base also includes a seat for receiving the rib of the tubular shell. The seat is positioned below the locking ledge and is configured to mate with the rib of the tubular shell cover to limit the relative rotational movement between the tubular shell cover and the tubular shell base when the cover is in the locked position.

The seat of the reduced diameter wall portion is a recess defined by a locking ramp and a locking abutment each of which is positioned beneath the locking ledge. Accordingly, when the tubular shell cover is positioned upon the shell base, it may be rotated in the direction of the locking ramp wherein the rib of the shell cover, which is formed of a resilient material, rides over the locking ramp, thereby seating within and relaxing within the seat of the reduced diameter wall portion. This provides a tactile indication that the cover is in the locked position. Further rotational movement is prevented by the locking abutment, thereby protecting the cosmetic retained within the cosmetic container. Axial movement is prevented by the locking ledge which extends circumferentially above the seat in which the rib is received. Accordingly, the shell cover maintains a locked position on the shell base and accidental removal of the shell cover is prevented.

The cosmetic container having the locking arrangement for securing the shell cover to the shell base according to the present invention is also effective when used in combination with a sealing mechanism for protecting the cosmetic and maintaining its moisture level. Such a sealing mechanism is disclosed in U.S. Pat. No. 5,533,823 to Pierpont et al. and is incorporated herein by reference. The Pierpont et al. patent discloses a bellows-like sealing member which is associated with the inner surface of the upper end of the tubular cover. The sealing member is arranged to mate with the inner sleeve to form a seal to protect the moisture-level of the cosmetic retained therein. The bellows-like sealing member according to that patent used in combination with the locking arrangement of the tubular shell cover and shell base of the present invention protects the cosmetic, such as lipstick, in that moisture depletion will be limited or at least significantly reduced, the shell cover will not be accidentally dislodged from the shell base, and the lipstick will not accidentally be extended within the shell cover due to accidental rotation of the shell base.

The shell cover may be removed from the shell base by applying rotational force to the cover in the opposite direction. Thus, the cover is only removed from the base when a predetermined amount of rotational force is applied to the cover. This arrangement provides a positive retention of the lipstick cover upon the lipstick base and provides a tactile indication to the user that the lipstick cover is in the locked position. This is due at least in part to the resilient nature of the rib and the limiting action provided by the locking ledge, the locking ramp, and the locking abutment.

The cosmetic container having the protective outer shell also includes a lipstick dispensing assembly. The lipstick dispensing assembly may be secured to the shell base which provides an outer protective shell for the dispensing assembly. The dispensing assembly includes a cosmetic carrier, a tubular inner sleeve, and a tubular outer sleeve.

The cosmetic carrier supports the lipstick and is generally configured as a sleeve having radially extending lugs on opposing sides and is received within the inner sleeve. The inner sleeve defines longitudinally extending channels on opposing sides wherein the lugs of the cosmetic carrier extend therethrough. An outer sleeve defining a continuous helical channel is positioned about the inner sleeve wherein the lugs of the cosmetic carrier are configured to be received in and to traverse along the length of the helical channel. This results in the cosmetic carrier being moved upwardly as the lugs traverse the length of the helical channel when a bottom portion of the intermediate sleeve is rotated. In operation, a bottom portion of the inner sleeve extends beyond the bottom of the outer sleeve and defines a rotatable base which is secured to the lower wall portion of the shell base. The user rotates the shell base to cause the cosmetic carrier and hence, the lipstick, to extend from the container for applying the lipstick and to retract into the container for storage.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE PREFERRED EMBODIMENTS

Figure 1:
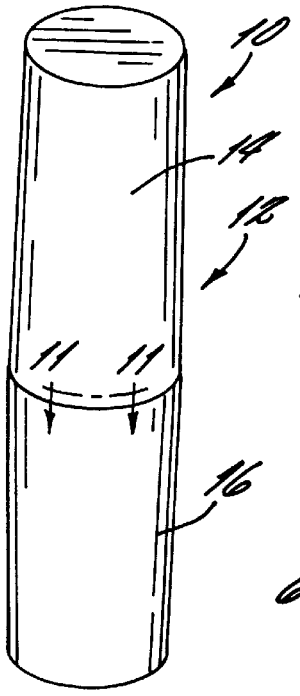
FIG. 1 is a perspective view of a cosmetic container according to the present invention.

The present invention will now be described more fully in detail with reference to the accompanying drawings, in which a preferred embodiment of the invention is shown. This invention should not, however, be construed as limited to the embodiment set forth herein; rather, it is provided so that this disclosure will be thorough and complete and will fully convey the scope of the invention to those skilled in the art.

The present invention as shown and described herein is a container for applying cosmetics, such as lipstick. However, it should be evident that the container has utility in various other areas wherein a product is to be extended from and retracted into a case. For instance, the container may be utilized for any product requiring topical application.

The lipstick container of the present invention, indicated generally by the reference character 10, is designed for dispensing lipstick so that it may be cosmetically applied. The lipstick container 10 includes a protective outer shell 12 defined by a tubular shell cover 14 and a tubular shell base 16. The tubular shell base 16 includes a lower cylindrical wall portion 18 and a reduced diameter wall portion 20 defining a flange 22.

A cosmetic dispensing assembly, shown generally at 24, is positioned within the protective outer shell 12. The dispensing assembly 24 is secured at least to the shell base 16 to extend and retract lipstick for its application. While a particular dispensing assembly 24 is described in detail before, it is to be understood that any dispensing assembly 24 may be positioned within and, preferably, secured to the outer shell 12.

The locking arrangement of the tubular shell cover 14 and the shell base 16 forming the outer shell 12 of the cosmetic container 10 will now be described more fully in detail. Preferably, both the shell base 16 and the shell cover 14 are formed of a plastic material. The shell base 16 includes the reduced diameter wall portion 20 and the lower cylindrical wall portion 18. As illustrated, the lower wall portion 18 has a diameter which is greater than the diameter of the wall portion 20. The wall portions 18 and 20 define a circumferential flange 22. The reduced portion 20 includes a radially outwardly extending locking member, shown generally at 26, having a locking ledge 28 which extends along at least a portion of the reduced wall portion 20. As shown, a pair of locking members 26 are provided, but it is within the spirit and scope of the present invention to provide at least one locking member 26 and any number of locking members 26.

Figure 6:
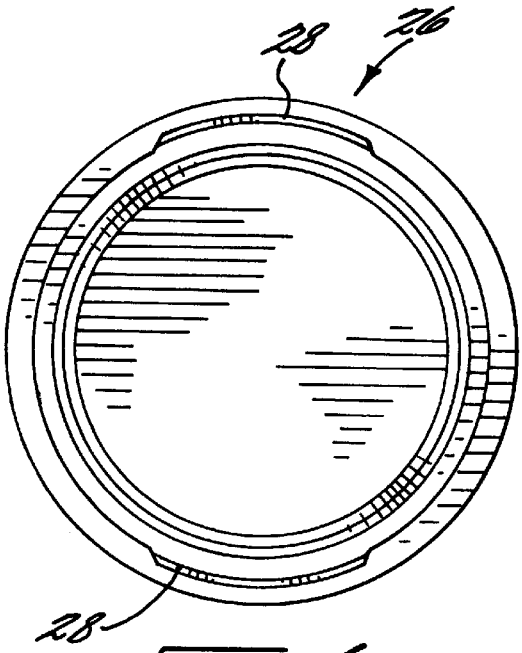
FIG. 6 is a top plan view of the container body of FIG. 3.

The locking ledge 28 of the locking member 26 is configured to mate with the shell cover 14 as described in more detail below. A seat 30 is positioned beneath the locking ledge 28. The seat 30 is defined by a recess which, in turn, is defined by a locking abutment 32 and a locking ramp 34 positioned on either side thereof. Each of the seat 30, the locking abutment 32, and the locking ramp 34 are positioned beneath the locking ledge 28. As illustrated, the locking abutment 32 and the locking ramp 34 extend radially outwardly from the outer surface of the reduced wall portion 20 of the shell base 16. The locking abutment 32 extends perpendicular to the locking ledge 28 which extends radially outwardly the same distance from the outer surface of the reduced wall portion 20 as the locking abutment 32. It is within the scope of the present invention, however, to provide the locking abutment 32 as a discrete member, separate from the locking ledge 28. The locking ramp 34 is defined by an inclined surface 36 and an abutting surface 38. Accordingly, when viewed from above, the sleeve base 16 appears to have a pair of radially outwardly extending protrusions on diametrically opposing surfaces extending along a circumferential portion thereof due to the position of the locking ledge 28 which extends above the locking abutment 32, the seat 30, and the locking ramp 34. This is best illustrated in FIG. 6.

Figure 7:
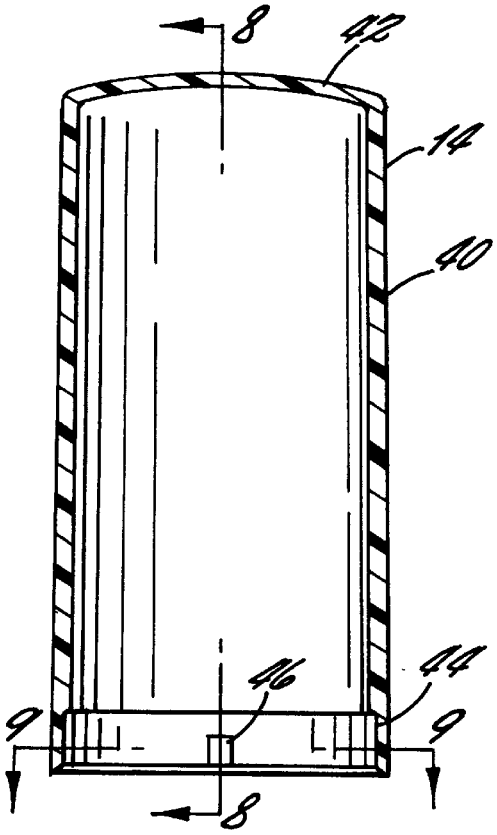
FIG. 7 is a cross-sectional view of the annular cover according to the present invention.
Figure 8:
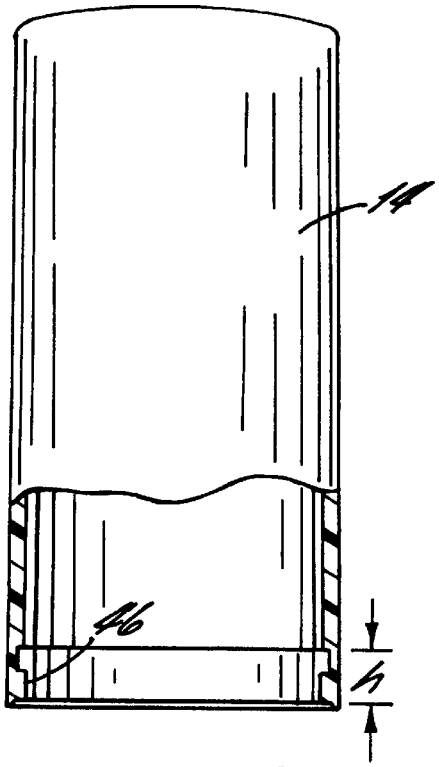
FIG. 8 is a side view, partially shown in cross-section, taken along line 8—8 of FIG. 7.
Figure 9:
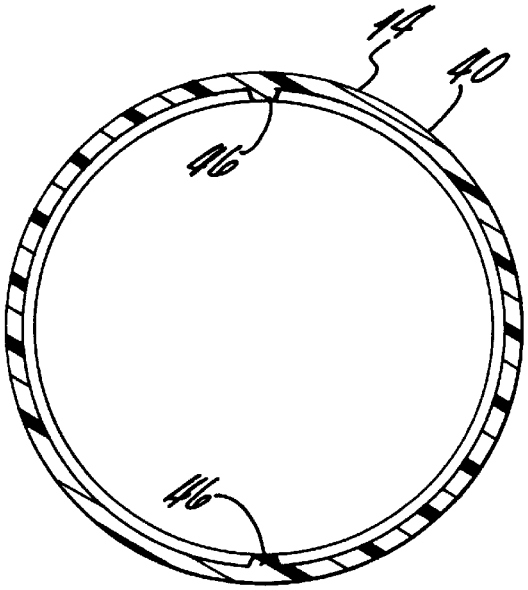
FIG. 9 is a cross-sectional view taken along line 9—9 of FIG. 7.

The shell cover 14 is best illustrated in FIGS. 7–9. The shell cover 14 is defined by sidewalls 40 and upper wall 42 defining a hollow interior and is selectively mounted to the shell base 16. The inner surface of the sidewall 40 forming the shell cover 14 defines, along its bottom edge, a portion having an increased inner diameter 44 as illustrated in FIG. 7. The height h of the portion 44 having the increased inner diameter substantially equates with the height of the reduced diameter wall portion 20 of the shell base 16. Within the increased diameter portion 44 are located a pair of radially inwardly extending ribs 46. As shown, a pair of ribs 46 are provided, but it is within the spirit and scope of the present invention to provide one or any number of ribs. Preferably, the number of ribs 46 corresponds with the number of locking members 26 on the shell base 16. The radially inwardly extending ribs 46 are configured to mate with the locking ledge 28, seat 30, locking abutment 32, and locking ramp 34 of the shell base 16. Preferably, the rib 46 is formed of a resilient material such as plastic, and is formed integral with the shell cover 14. It may also, however, be formed separately from the shell cover 14 and then be secured thereon.

Figure 10:
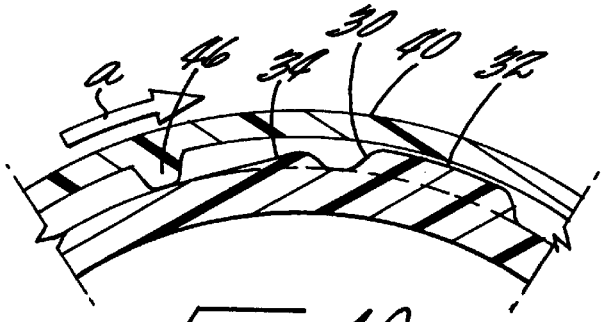
FIG. 10 is a cross-sectional view taken along line 11—11 of FIG. 1 illustrating the unlocked position.
Figure 11:
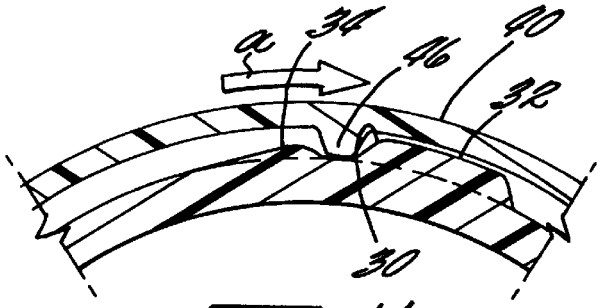
FIG. 11 is a cross-sectional view taken along line 11—11 of FIG. 1 illustrating the locked position.

The cooperation of the rib 46 of the shell cover 14 and the locking member 26 of the shell base 16 is best illustrated in FIGS. 10 and 11. In operation, the shell cover 14 is placed upon the shell base 16 wherein the increased diameter portion 44 of the shell cover 14 is positioned around the reduced diameter wall portion 20 of the shell base 16. The shell cover 14 may then be rotated in a predetermined direction indicated by arrow a, facing the inclined surface 36 of the locking ramp 34. Accordingly, the rib 46 of the shell cover 14 may be rotated so as to resiliently traverse the length of the inclined surface 36 of the locking ramp 34 and then relaxing within the seat 30. The rib 46 is maintained in position between the locking abutment 32 and the abutting surface 38 of the locking ramp 34. Therefore, further rotational movement of the shell cover 14 relative to the shell base 16 is limited.

Relative axial movement between the shell cover 14 and the shell base 16 is substantially prohibited due to the extending locking ledge 28 positioned above the seat 30. Upward axial force applied to the shell cover 14 causes the ribs 46 to contact the locking ledge 28 which precludes further upward axial movement of the shell cover 14. Thus, the cosmetic container 10 assumes a locked position both as to relative axial and rotational displacement of the shell cover 14.

To assume an unlocked position, the shell cover 14 is merely rotated in the opposite direction (opposite that shown by arrow a in FIG. 11) wherein the resilient rib 46 rides over the abutting surface 38 of the locking ramp 34 upon rotational forces of a predetermined amount. When the rib 46 is removed from the seat 30, and clear of the locking ramp 34, the shell cover may be removed from the shell base 16 by applying axial force. Accordingly, only upon the application of a predetermined rotational force will the cosmetic container 10 assume an unlocked position, and therefore, accidental removal of the shell cover 14 from the shell base 16 is substantially precluded.

The lipstick container 10 includes a plurality of tubular members which are concentrically arranged about the longitudinal axis 1. The lipstick is positioned within a cosmetic carrier 48 shown in the form of a cup to secure the lipstick therein. The cosmetic carrier 48 also includes a pair of lugs 50 positioned on diametrically opposing outer surfaces of the sidewall of the cosmetic carrier 48. Although the lugs 50, as shown, are provided as a pair and are diametrically opposed, it would not be a departure from the scope of the present invention to provide one or any number of lugs in any location along the outer surface of the cosmetic carrier 48.

Figure 2:
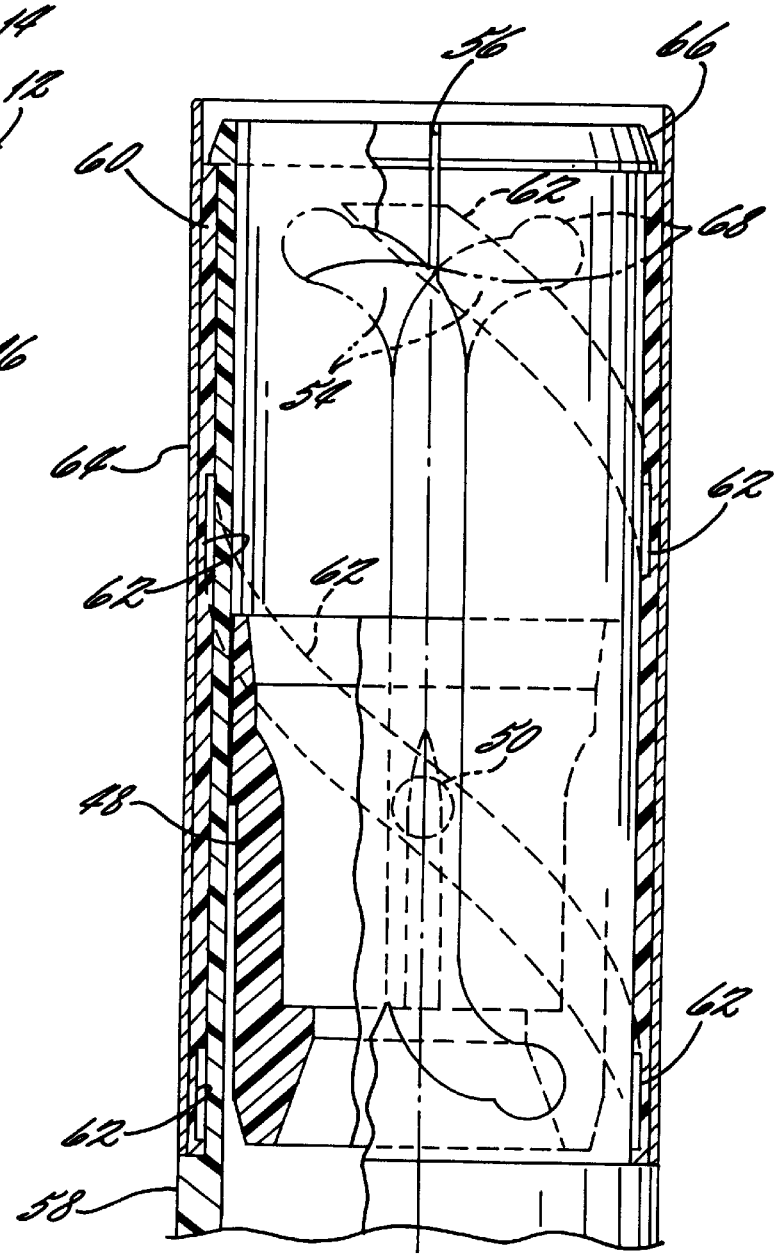
FIG. 2 is a cross sectional view of the lipstick dispensing assembly within the protective outer shell.
Figure 3:
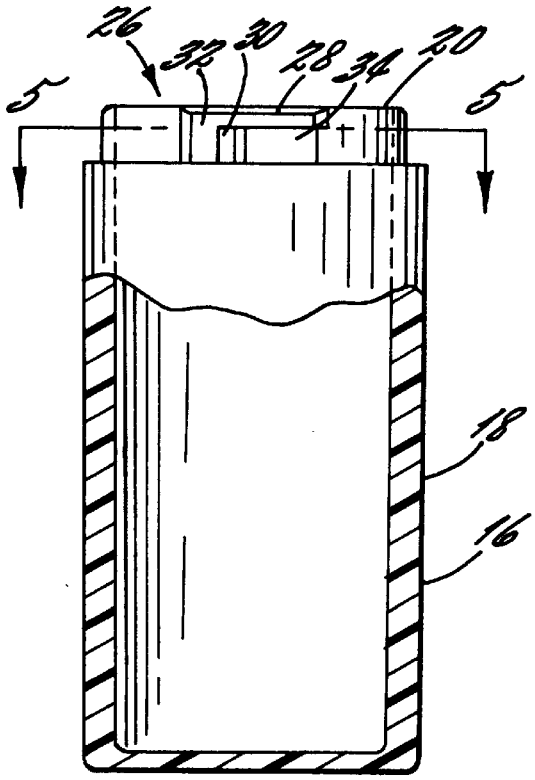
FIG. 3 is a perspective view of the container body with a portion thereof broken away.
Figure 4:
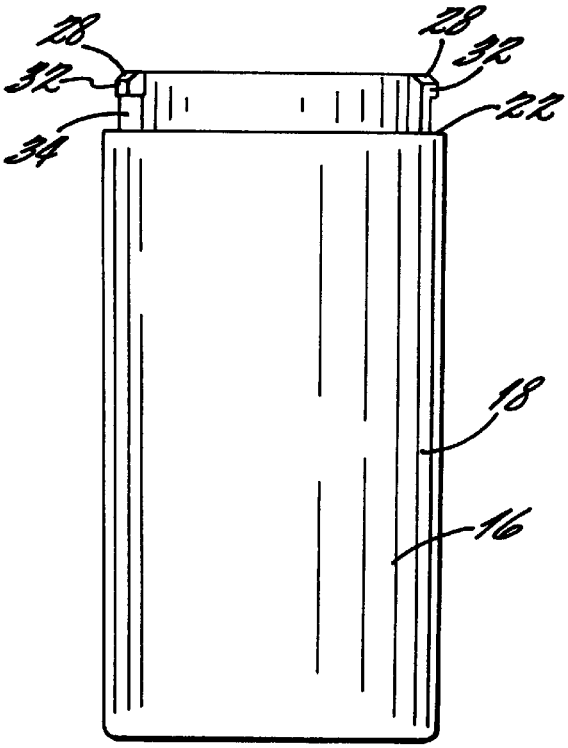
FIG. 4 is a side, elevational view of the container body of FIG. 3 rotated 90°.
Figure 5:
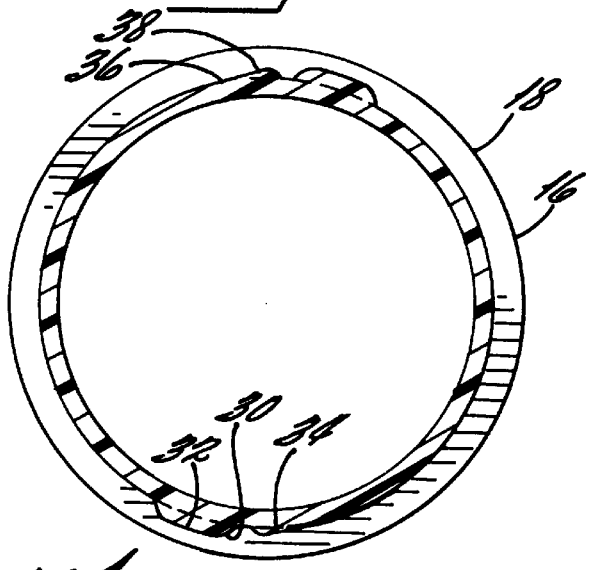
FIG. 5 is a cross-sectional view taken along line 5—5 of FIG. 3.

As best illustrated in FIG. 2, the cosmetic carrier 48 is positioned within a tubular inner sleeve 52. The tubular inner sleeve 52 includes, on opposing sidewalls, a pair of longitudinal slots 54 which extend parallel to the longitudinal axis l of the cosmetic container 10. Positioning of the cosmetic carrier 48 within the inner sleeve 52 is enhanced by the integral opening 56 provided along the upper end of the longitudinal slot 54 of the tubular inner sleeve 52. Once positioned within the tubular inner sleeve 52, the cosmetic carrier 48 is movable longitudinally upwardly or downwardly within the inner sleeve 52. The longitudinal slots 54 permit the lugs 50 of the cosmetic carrier 48 to extend therethrough. At its bottom end, the tubular inner sleeve 52 comprises a manually rotatable base portion 58.

A tubular intermediate sleeve 60 is positioned circumferentially around the tubular inner sleeve 52. The intermediate sleeve 60 includes a pair of opposed helical channels 62 formed on its inner surface. The helical channels 62 are defined by opposing upper and lower sidewalls and a bottom wall and are configured to receive at least a portion of the lug or lugs 50 as shown in the various figures.

A tubular outer sleeve 64 is positioned circumferentially around the intermediate sleeve 60 and the helical channel 62. The tubular outer sleeve 64, may be a decorative component. In an alternative embodiment, the intermediate sleeve 60 and the tubular outer sleeve 64 may be integrally formed wherein the tubular outer sleeve 64 may constitute the bottom wall of the helical channel 62 and the intermediate sleeve 60 includes a helical slot (not shown) defined by upper and lower sidewalls.

Figure 12:
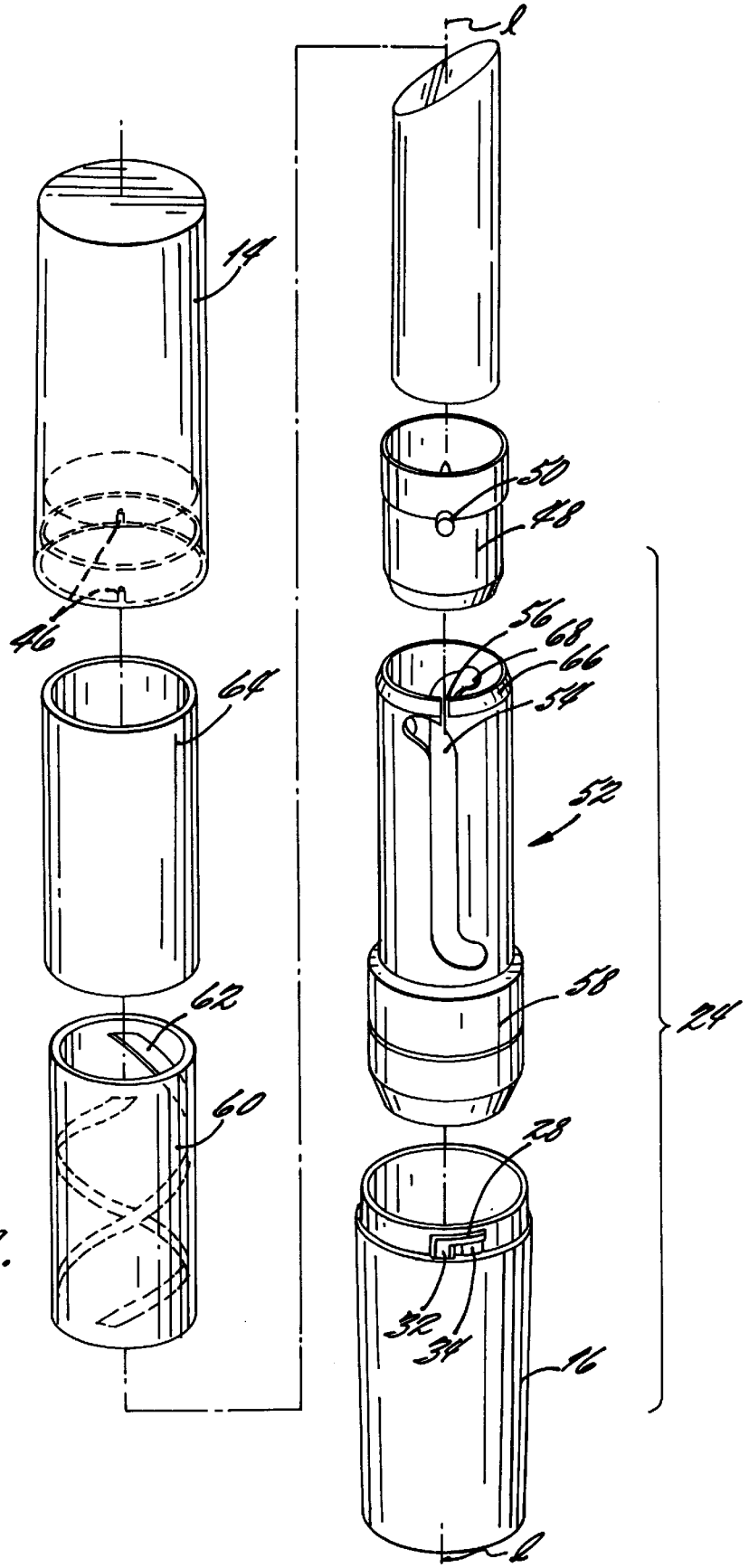
FIG. 12 is an exploded view of the cosmetic container of FIG. 1.

The above-described components of the lipstick container 10 permit easy application of the lipstick by permitting the lipstick to be extended from and retracted within the lipstick container 10. The assembly, shown exploded in FIG. 12, is maintained in proper alignment and positioning due to the configuration of the various components. For instance, the upper portion of the tubular inner sleeve 52 includes a thickened portion extending radially outward so as to form a flange 66. Similarly, the rotatable base portion 58 of the inner sleeve 52 also forms a flange wherein the intermediate sleeve 60 and the tubular outer sleeve 64 are retained between the flange 66 and the base portion 58.

The operation of the cosmetic container 10 according to the present invention will now be described with reference to the various figures. The cosmetic container extends and retracts the lipstick to prevent extension thereof beyond the upper end of the cosmetic container 10 so that it may be applied. The lipstick is propelled within and from the cosmetic container 10 by removal of the shell cover 14 and by the rotation of the shell base 16 to which the rotatable base portion 58 of the inner sleeve 52 is secured. While the base portion 58 may be secured to the shell base 16 in any manner, preferably, it is secured thereto by an adhesive or glue. Rotating the shell base 16 in a predetermined direction causes the cosmetic carrier 48 retained therein to likewise rotate due to the extension of the lugs 50 through the longitudinal slots 54 which would, inherently, abut a respective longitudinal side edge defining the longitudinal slot 54 (depending upon the direction of rotation). Because the lugs 50 are also received, or at least a portion thereof, within the helical channel 62, as the tubular rotatable inner sleeve 52 is rotated, the cosmetic carrier 48 traverses the length of the helical channels 62 of the intermediate sleeve 60 wherein it is moved upward or downward within the longitudinal slots 54.

At each of the upper and lower ends of the longitudinal slot 54 are provided laterally extending locking extensions 68 which, as shown, are formed integrally with the longitudinal slots 54. The locking extensions 68 limit the movement of the cosmetic carrier 48 so that when the cosmetic carrier 48 reaches the uppermost position, it is restrained from further upward movement because further rotatable movement of the rotatable base portion 58 is prohibited. Likewise, when the lipstick within the cosmetic carrier 48 is fully retracted, further retraction is limited due to the retention of the lug 50 within the lower laterally extending locking extension 68 of the longitudinal slot 54. Thus, the lipstick may be extended by rotating the shell base 16 in one direction, and retracted by rotating the shell base 16 in the opposite direction to permit easy application while protecting the lipstick within the cosmetic container 10 when not in use.

While particular embodiments of the invention have been described, it will be understood, of course, that the invention is not limited thereto since modifications may be made by those skilled in the art, particularly in light of the foregoing teachings. It is therefore contemplated by the appended claims to cover any such modifications that incorporate those features or these improvements in the true spirit and scope of the invention.

That which is claimed:

1. A cosmetic container comprising:

at least one tubular sleeve;

a cosmetic carrier positioned within said at least one tubular sleeve and being movable therein along the longitudinal axis of said tubular sleeve;

an outer shell having a tubular shell base and a tubular shell cover, said shell base having a lower cylindrical wall portion and a reduced diameter wall portion and said shell cover being selectively positioned on said shell base and being moveable between a locked and unlocked position, said shell cover having an inner surface facing said reduced wall portion of said shell base, when said shell cover is positioned on said shell base, and having at least one radially inwardly extending rib extending along at least a portion of said inner surface of said shell cover, said reduced wall portion having at least one radially outwardly extending locking member including an axial locking ledge configured to mate with said rib to substantially prevent relative axial movement between said shell cover and said shell base when said cover is in the locked position and a locking ramp defined by an inclined surface and an abutting surface, said inclined surface and said abutting surface being positioned beneath said locking ledge, said locking ledge extending along at least a portion of said reduced wall portion, said reduced wall portion further including a seat defined at least in part by said abutting surface for receiving said rib of said shell cover in the locked position for substantially limiting relative rotational movement between said shell cover and said shell base when said shell cover is in the locked position.

2. A cosmetic container according to claim 1 wherein said seat is positioned below said locking ledge on said reduced wall portion.

3. A cosmetic container according to claim 1 wherein said seat is a recess defined by said reduced wall portion.

4. A cosmetic container according to claim 1 wherein said locking member further includes a locking abutment positioned axially below said locking ledge wherein said seat is positioned between said locking ramp and said locking abutment which define said seat wherein said rib of said shell cover rides over said locking ramp and seats within said seat, such that when said cover is in the locked position, said locking abutment and said locking ramp substantially limit relative rotational movement between said shell cover and said shell base and said locking ledge substantially limits relative rotational movement between said shell cover and said shell base when said shell cover is in the locked position.

5. A cosmetic container according to claim 1 wherein said rib of said shell cover is resilient.

6. A cosmetic container according to claim 1 wherein said at least one tubular sleeve is an outer sleeve having a helical channel extending along an inner periphery of said outer sleeve.

7. A cosmetic container according to claim 6 wherein said cosmetic carrier includes at least one radially outwardly extending lug wherein said cosmetic carrier is movable longitudinally upwardly or downwardly within said at least one sleeve.

8. A cosmetic container according to claim 7 further comprising a second, tubular inner sleeve rotatable within said at least one tubular sleeve with a longitudinal slot formed in said tubular inner sleeve extending parallel to the longitudinal axis thereof with said lug extending radially outwardly through said longitudinal slot of said inner sleeve and traversing the length of the helical channel.

9. A cosmetic container according to claim 8 wherein at least a portion of said inner sleeve extends axially beyond the lower end of said outer sleeve and is positioned within said shell base to define a manually rotatable base so that upon rotation of said manually rotatable base, said cosmetic carrier will be propelled longitudinally upwardly or downwardly.

10. A cosmetic container according to claim 9 wherein said manually rotatable base is secured to said shell base.

11. A cosmetic container according to claim 1 wherein a portion of said at least one tubular sleeve is positioned within said shell base.

12. A cosmetic container according to claim 1 wherein said shell cover includes a sidewall defining an increased diameter portion and said rib extends radially inwardly from said increased diameter portion.

13. A cosmetic container according to claim 1 wherein said seat for said rib is substantially the same circumferential width as said rib.

14. An outer shell for a cosmetic container comprising:

a tubular shell base having a lower cylindrical wall portion and a reduced diameter wall portion; and a tubular shell cover being selectively positioned on said shell base and being moveable between a locked and unlocked position about said shell base, said cover having an inner surface facing said reduced wall portion of said shell base when said cover is positioned on said shell base and a radially inwardly extending rib extending along at least a portion of said inner surface of said shell cover, said reduced diameter wall portion defining a radially outwardly extending locking member including an axial locking ledge for mating with said rib to substantially limit relative axial movement between said cover and said shell base when said cover is in the locked position, and a locking ramp defined by an inclined surface and an abutting surface each positioned beneath said locking ledge, said locking ledge extending around at least a portion of said reduced wall portion, said reduced wall portion further including a seat defined at least in part by said abutting surface for receiving said rib of said cover in the locked position, said seat being positioned below said locking ledge on said reduced wall portion and being configured to substantially limit relative rotational movement between said shell cover and said shell base when said cover is in the locked position.

15. An outer shell according to claim 14 wherein said seat is a recess defined by said reduced diameter wall portion.

16. An outer shell according to claim 14 wherein said locking member further includes a locking abutment positioned axially below said locking ledge wherein said seat is positioned between said locking ramp and said abutment which define said recess wherein said rib of said shell cover rides over said locking ramp and seats within said seat, such that when said shell cover is in the locked position said abutment and said locking ramp substantially limit relative rotational movement between said shell cover and said shell base and said locking ledge substantially limits relative rotational movement between said shell cover and said shell base when said shell cover is in the locked position.

17. An outer shell according to claim 14 wherein said rib of said shell cover is resilient.

18. An outer shell according to claim 14 wherein said locking member is formed integral with said reduced diameter wall portion of said shell base.

19. An outer shell according to claim 14 wherein said shell base includes at least a pair of locking members positioned on diametrically opposite surfaces thereof.

20. An outer shell according to claim 14 wherein said shell cover includes at least a pair of ribs positioned on diametrically opposite surfaces thereof.

21. A cosmetic container according to claim 14 wherein said shell cover includes a sidewall defining an increased diameter portion and said rib extends radially inwardly from said increased diameter portion.

22. A cosmetic container according to claim 14 wherein said seat for said rib is substantially the same circumferential width as said rib.

* * * * *